United States Patent [19]

Eriksson et al.

[11] 4,176,657

[45] Dec. 4, 1979

[54] APPARATUS FOR WAXING SKIS

[75] Inventors: Åke Eriksson, Upplands Väsby; Åke Norin, Jarfällä, both of Sweden

[73] Assignee: Primus-Sievert AB, Sundbyberg, Sweden

[21] Appl. No.: 846,353

[22] Filed: Oct. 28, 1977

[51] Int. Cl.[2] ..... F24J 3/00; F23C 5/02

[52] U.S. Cl. ..... 126/401; 126/271.2 R

[58] Field of Search ..... 118/101; 126/271.2 R, 126/271.2 A, 401, 407, 404, 412; 404/79, 95; 15/150

[56] References Cited

U.S. PATENT DOCUMENTS

| | | | |
|---|---|---|---|
| 1,187,821 | 6/1916 | Dempster et al. | 126/401 |
| 1,378,675 | 5/1921 | Hauck | 126/401 |
| 1,509,236 | 9/1924 | Greene | 126/401 |
| 1,967,406 | 7/1934 | Hicks | 15/150 |
| 2,684,531 | 7/1954 | Smith | 126/401 X |
| 2,692,641 | 10/1954 | Woods | 126/401 |
| 3,079,980 | 3/1963 | Mihm | 126/401 |
| 3,171,466 | 3/1965 | Katchur, Jr. | 126/401 |
| 3,711,678 | 1/1973 | Kuus | 118/101 X |

*Primary Examiner*—John P. McIntosh

*Attorney, Agent, or Firm*—Wigman & Cohen

[57] ABSTRACT

This disclosure relates to apparatus for waxing skis comprising a gas burner assembly adapted to be connected to a can of gas, and a waxing iron releasably attached to the gas burner assembly by means of a quick connect-disconnect device including a resilient snap element. The waxing iron includes a bottom plate having a convex configuration whereby only a limited portion of the surface area thereof may contact the surface of a ski thereby preventing burning of the ski or the wax being spread thereon.

6 Claims, 5 Drawing Figures

APPARATUS FOR WAXING SKIS

BACKGROUND OF THE INVENTION

This invention relates generally to apparatus for waxing skis, and more particularly to an improved ski waxing iron that may be easily and safely connected to and disconnected from a burner head assembly, and which has a configuration which reduces the risk of burning the wax or the ski.

The art of ski waxing is as old as the sport of skiing itself. It has long been known that waxing the soles of skis renders them smoother which facilitates gliding and turning, and thus makes for greater safety. In addition, in the case of wooden skis, the wax renders them more water-repellent, and thus the entire surface of wooden skis may be advantageously waxed.

In the case of modern plastic skis having soles made of porous polyethylene or the like with a somewhat roughened gliding surface, waxing fills the pores of the soles creating a smoother water-repellent surface.

It is also known in the art that the most effective waxing is achieved if the wax is ironed out onto the ski by means of a heated waxing iron. Initially this was carried out by means of an element made of iron or steel or the like which was heated over a fire and then used to melt wax and smooth it out over the ski surface. With the advent of canned gas, such as propane, waxing could be accomplished by means of a portable hand-held apparatus in which a gas burner assembly, attached to a small canister of gas, carried a waxing iron which was heated by a flame continuously emitting from the gas burner.

There are, however, several disadvantages with the aforementioned known type of portable waxing iron. First of all, it is difficult to control the heat of the iron which often leads to burning of the wax or the surface of the ski. The waxing iron usually has a flat bottom plate which can get very hot and which can transfer execessive amounts of heat to the ski, particularly if the iron is momentarily held stationary or if it is moved too slowly over the surface of the ski. In addition, under certain circumstances it is desirable to remove the iron from the burner assembly and to use the open flame burner by itself. However, because in the prior art ski waxing apparatus the iron is attached to the burner assembly by means of screw clamps, or the like, it is a difficult and time-consuming procedure to remove the iron from the burner, particularly if the iron is hot.

SUMMARY OF THE INVENTION

It should be apparent, therefore, that a need still exists in the art for a ski waxing apparatus having a waxing iron attached to a burner assembly which overcomes the disadvantages of prior art apparatus of this type. Accordingly, it is a primary object of this invention to provide apparatus for waxing skis in which the risk of burning the wax or the surface of the skis is reduced.

More particularly, it is an object of this invention to provide apparatus for waxing skis in which only a limited portion of the surface area of the waxing iron my contact the surface of the ski at any time.

Another object of this invention is to provide apparatus for waxing skis of the aforementioned type wherein the waxing iron has a substantially L-shaped longitudinal cross-sectional profile and it includes a leg portion for receiving the burner head and a base portion for spreading wax over the sole of a ski, the base portion including a plate having top and bottom surfaces, the top surface defining a trough for receiving and retaining a flame emanating from the burner head and adapted to heat the waxing iron, and wherein the bottom surface has a convex configuration whereby only a limited portion of the surface area thereof may contact the surface of the ski thereby preventing burning of the ski or the wax being spread thereon.

A further object of this invention is to provide apparatus for waxing skis of the aforementioned type wherein the waxing iron is attached to the burner assembly in a safe and reliable manner, and yet which may be disconnected from the burner assembly in a knock-off fashion.

Yet another object of this invention is to provide apparatus for waxing skis of the aforementioned type wherein the waxing iron is releasably attached to the burner assembly by means of a quick connect-disconnect device including a resilient snap element.

Still another object of this invention is to provide improved apparatus for waxing skis which is safe and reliable in operation and which may be effectively utilized to spread wax over the surface of skis.

Briefly described, these and other objects of the invention that may become more apparent hereinafter are accomplished in accordance with this invention by providing apparatus for waxing skis comprising a waxing iron, a gas burner assembly including a fish-tail burner head and a controllable valve element for attaching the burner assembly to a canister of gas, and a quick connect-disconnect knock-off device including a resilient snap element for releasably attaching the waxing iron to the burner assembly.

The waxing iron has a substantially L-shaped longitudinal cross-sectional profile and includes a leg portion for receiving the fish-tail burner head and a base portion for spreading wax over the sole of a ski. The base portion includes a plate, preferably formed of brass or the like, having top and bottom surfaces. The top surface of the plate includes an upstanding flange which extends about the perimeter thereof and defines a trough for receiving and retaining a flame emanating from the burner head which is adapted to heat the waxing iron. The bottom surface of the plate, which is adapted to contact the surface of a ski and spread wax thereover, has a slightly convex configuration whereby only a limited portion of the surface area thereof may contact the surface of a ski thereby preventing burning of the ski or the wax being spread thereon.

The quick connect-disconnect device permits the waxing iron to be easily removed from the burner head in a knock-off manner, thereby facilitating removal when the waxing iron is hot. To this end, the device includes a U-shaped rod pivotably connected at the ends thereof to the waxing iron, and a resilient wire having a generally U-shaped configuration with a bight portion and two leg portions. The leg portions are bent back upon themselves defining a generally V-shaped longitudinal cross-section. The bight portion of the resilient wire is pivotably connected to the U-shaped rod, and when the waxing iron is attached to the burner head the resilient wire is pivoted in a first direction and the bent back leg portions thereof are snapped under one side of the burner head thereby pivoting the U-shaped rod down against the other side of the burner head and providing a secure rigid connection.

With the above and other objects in view that may become apparent hereinafter, the nature of the invention may be more clearly understood by reference to the several views illustrated in the attached drawings, the following detailed description thereof, and the appended claimed subject matter; wherein:

Figure 4:
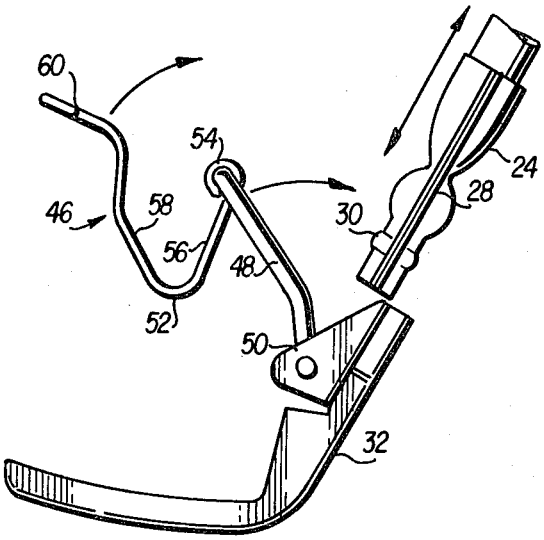
Figure 5:
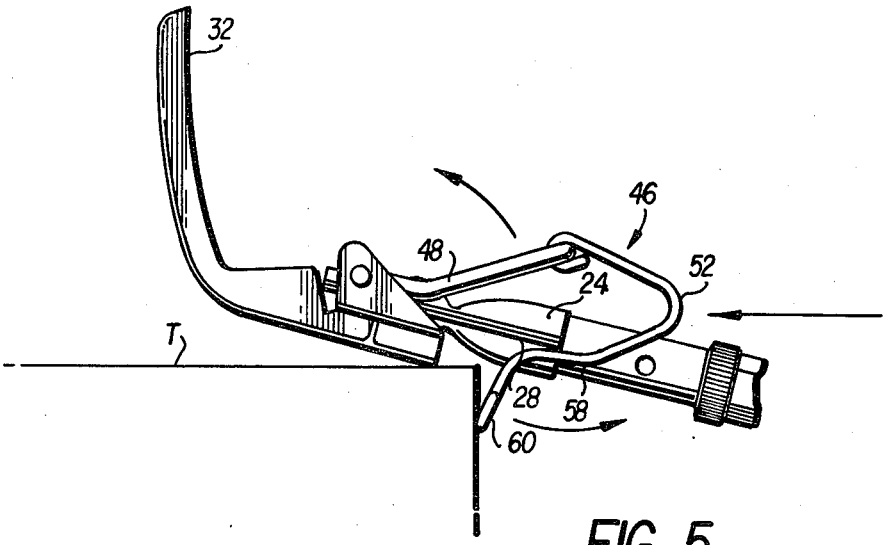

FIG. 4 is a side view of the waxing iron and the burner head, and schematically illustrates the manner in which the resilient snap element is pivotably moved to connect the waxing iron to the burner head; and FIG. 5 is a fragmentary side view of the ski waxing apparatus of this invention, depicting the waxing iron and the burner head in their connected position and schematically illustrating the manner in which the resilient snap element may be knocked-off disconnecting the waxing iron from the burner head.

DETAILED DESCRIPTION OF PREFERRED EMBODIMENT

Figure 1:
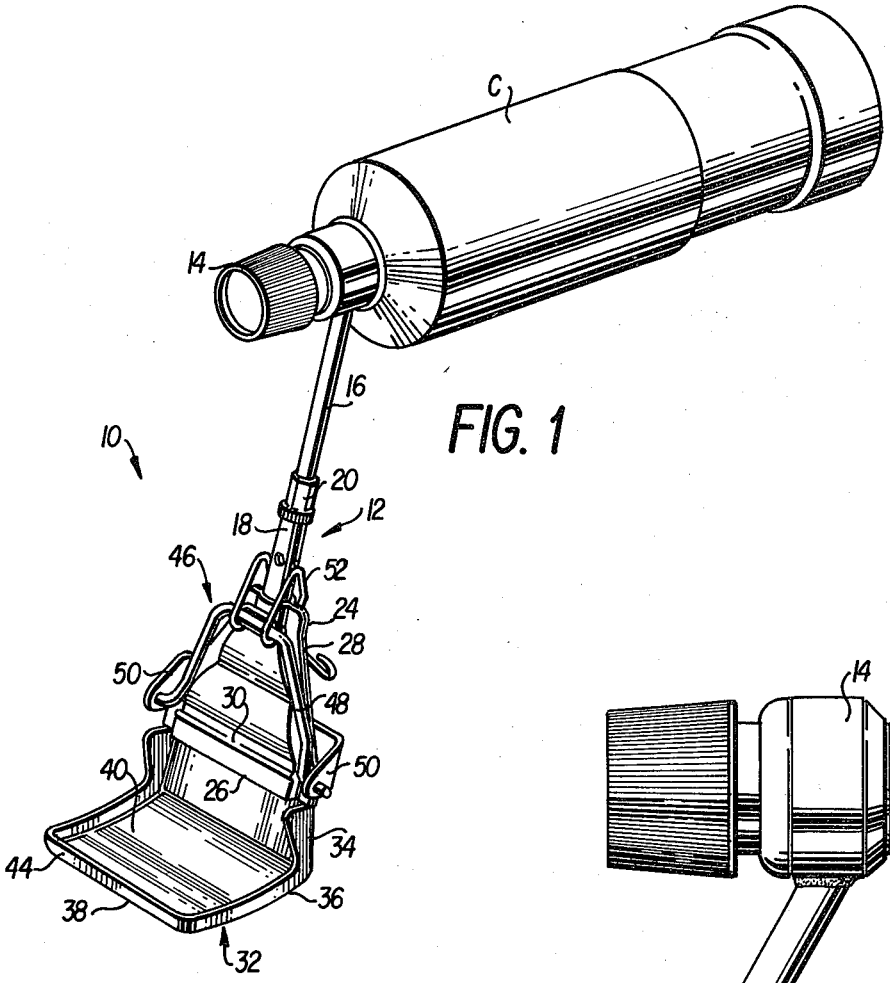
FIG. 1 is a perspective view of apparatus for waxing skis constructed in accordance with this invention, and depicts a canister of gas having the burner assembly extending therefrom with the waxing iron connected to the burner head.

Referring now to the drawings in detail, there is illustrated in FIG. 1 apparatus for waxing skis constructed in accordance with this invention and designated generally by the numeral 10. The apparatus 10 includes a burner assembly 12 having a controllable valve element 14 by means of which the apparatus 10 may be attached to a canister of gas C, such as propane or the like. The valve element 14 is of a conventional type known to those skilled in the art and is thus not described in detail herein.

The burner assembly 12 includes a first tube 16 extending from the valve element 14 and connected to a second tube 18 by means of a threaded coupling 20. The second tube 18 preferably includes apertures 22 for the intake of air. A conventional fish-tail type burner head 24 having a flared outlet 26 is connected to the second tube 18 in a known manner. The burner head 24 further includes a peripherally-extending flange 28 and a transverse rib 30 spaced from and extending parallel to the outlet opening 26.

The ski waxing apparatus 10 also includes a waxing iron 32 having a leg portion 34 for receiving the burner head 24, and a base portion 36 for spreading wax W over the surface of a ski S. The base portion 36 includes a plate 38 having an upper surface 40 and a lower surface 42. An upstanding flange 44 extends about the perimeter of the base portion 36 defining a trough therein.

Figure 2:
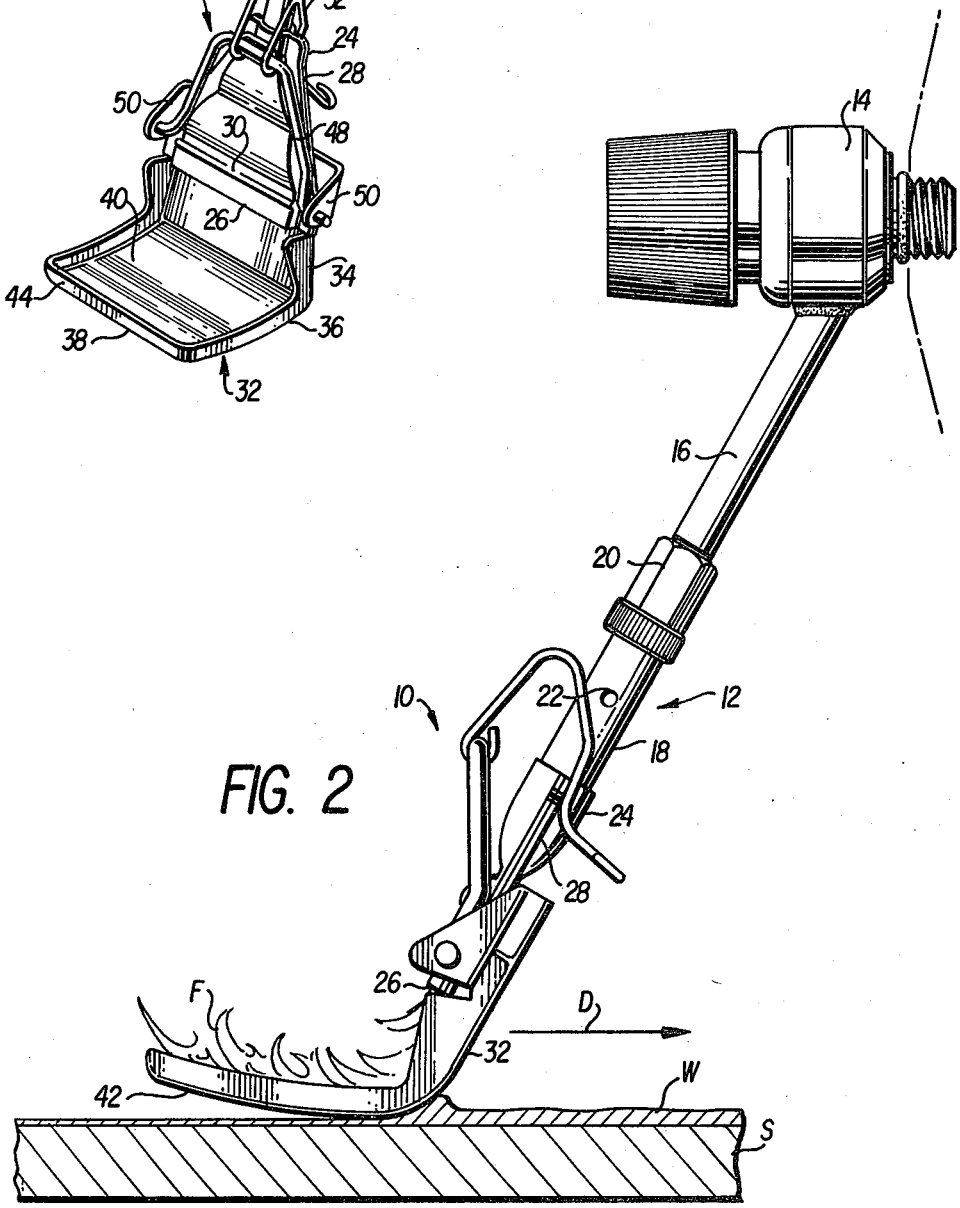
FIG. 2 is a side view of the ski waxing apparatus of this invention, and depicts the waxing iron, being heated by a flame emanating from the burner assembly, moving over the surface of a ski and spreading wax thereon.

In operation, as seen most clearly in FIG. 2, the flames F emanating from the outlet 26 of the burner head 24 spread out over the upper or top surface 40 of the plate 38, thus heating the waxing iron 32. Wax W, which may be applied to the surface of the ski S in liquid form or melted thereover from a solid cake by contact with the waxing iron 32, is spread over the surface of the ski S by the convex lower or bottom surface 42 of the waxing iron 32. Inasmuch as the suface 42 is curved in the direction of travel D of the apparatus 10, only a limited portion of the surface area of the waxing iron 32 will contact the wax W or the surface of the ski S.

Figure 3:
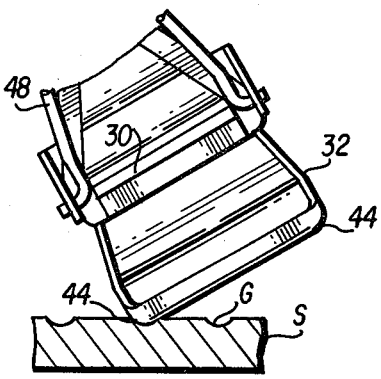
FIG. 3 is a fragmentary front view of the ski waxing apparatus, and depicts a rounded edge of the waxing iron inserted into a groove in a ski for spreading wax therein.

As seen most clearly in FIG. 3, the waxing iron 32 includes rounded side edges 44 which are adapted to fit into grooves G in the surface of skis S, thereby facilitating the spreading of wax therein.

The apparatus 10 further includes a quick connect-disconnect device 46 for connecting the waxing iron 32 to the burner head 24. As seen most clearly in FIG. 4, the device 46 is a resilient snap element including a generally U-shaped rod 48 which is pivotably mounted in flanges 50 extending from the waxing iron 32. A generally U-shaped resilient wire 52 having a bight portion 54 and leg portions 56 is pivotably mounted at the bight portion 54 thereof on the rod 48. The leg portions 56 are bent back upon themselves as seen at 58 in FIG. 4, thereby defining a generally V-shaped longitudinal cross-sectional profile. The leg portions 56 terminate in outwardly extending ends 60.

When it is desired to connect the waxing iron 32 to the burner head 24, the burner head 24 is inserted between the flanges 50 and the quick connect-disconnect device 46 pivoted in the clockwise direction as illustrated in FIG. 4. The rod 48 is pressed down against one side of the flange 28 of the burner head 24, and the resilient wire 52 pivoted about the rod 48 until the bent-back leg portions 58 thereof are snapped under the other side of the flange 28. As seen most clearly in FIGS. 1 and 3, the rod 48 in this position will bear against the transverse rib 30, thus preventing removal of the waxing iron 32 from the burner head 24.

When it is desired to disconnect the waxing iron 32 from the burner head 24, the quick connect-disconnect device 46, as seen most clearly in FIG. 5, may be simply knocked-off by striking the end portions 60 of the wire 52 against the side of a rigid abutment such as a table T or the like. This will cause the wire 52 to snap out from under the flange 28 thereby releasing the rod 48 from its rigid engagement with the transverse rib 30. The waxing iron 32 can then be simply dropped off the end of the burner head 24.

In view of the foregoing, it should be apparent that there is provided in accordance with this invention an improved apparatus for waxing skis wherein the waxing iron has a convex configuration which prevents burning of the wax or the skis, and which incorporates a novel quick connect-disconnect device whereby the waxing iron may be attached to the burner assembly without the use of screw clamps or the like and which facilitates release of the waxing iron in a knock-off manner.

Although only a preferred embodiment of the invention has been specifically illustrated and described herein, it is to be understood that minor modifications could be made therein without departing from the spirit and scope of the invention as defined in the appended claims.

We claim:

1. Apparatus for waxing skis comprising a waxing iron, a gas burner assembly including controllable valve means for attaching said burner assembly to a can of gas, said burner assembly having a burner head, means for releasably attaching said waxing iron to said burner assembly, said waxing iron having a substantially L-shaped longitudinal cross-sectional profile and including a leg portion for receiving said burner head and a base portion for spreading wax over the sole of a ski, said base portion including a plate having top and bottom surfaces, said top surface defining a trough for receiving and retaining a flame emanating from said burner head and adapted to heat said waxing iron, and wherein said bottom surface has a convex configuration whereby only a limited portion of the surface area thereof may contact the surface of a ski thereby preventing burning of the ski or the wax being spread thereon, wherein said means for releasably attaching said waxing iron to said burner assembly is a quick connect-disconnect device including a resilient snap element, said releasably attaching means further including a U-shaped rod pivotally connected at the ends thereof to said waxing iron, said resilient snap element comprising a resilient wire having a generally U-shaped configuration with a bight portion and two leg portions and wherein said leg portions are bent back upon themselves defining a generally V-shaped longitudinal cross-section, the bight portion of said resilient wire being pivotally connected to said U-shaped rod, and wherein when said waxing iron is attached to said burner assembly said resilient wire is pivoted in a first direction and the bent back leg portions thereof snapped under one side of said burner assembly thereby pivoting said U-shaped rod down against the other side of said burner assembly.

2. Apparatus as defined in claim 1, said burner assembly including a burner head having a peripherally extending flange, said waxing iron including two upstanding flanges spaced apart to receive said burner head therebetween, means in said flanges for pivotally mounting the ends of said U-shaped rod, and wherein said peripherally extending flange is pressed between said U-shaped rod and said waxing iron when said resilient wire is snapped under said one side of said burner assembly.

3. Apparatus as defined in claim 1, wherein said bent back leg portions of said resilient wire, when snapped into the connected position thereof, extend outwardly from said burner assembly a distance sufficient for said bent back leg portions to be struck against a surface thereby pivoting said resilient wire in a direction opposite to said first direction and releasing said quick connect-disconnect device in a knock-off manner.

4. Apparatus for waxing skis comprising a waxing iron, a gas burner assembly including controllable valve means for attaching said burner assembly to a can of gas, means for rleasably attaching said waxing iron to said burner assembly, and wherein said releasably attaching means is a quick connect-disconnect device including a resilient snap element, said releasably attaching means further including a U-shaped rod pivotally connected at the ends thereof to said waxing iron, said resilient snap element comprising a resilient wire having a generally U-shaped configuration with a bight portion and two leg portions and wherein said leg portions are bent back upon themselves defining a generally V-shaped longitudinal cross-section, the bight portions of said resilient wire being pivotally connected to said U-shaped rod, and wherein when said waxing iron is attached to said burner assembly said resilient wire is pivoted in a first direction and the bent back leg portions thereof snapped under one side of said burner assembly thereby pivoting said U-shaped rod down against the other side of said burner assembly 5. Apparatus as defined in claim 4, said burner assembly including a burner head having a peripherally extending flange, said waxing iron including two upstanding flanges spaced apart to receive said burner head therebetween, means in said flanges for pivotally mounting the ends of said U-shaped rods, and wherein said peripherally extending flange is pressed between said U-shaped rod and said waxing iron when said resilient wire is snapped under said one side of burner assembly.

6. Apparatus as defined in claim 4, wherein said bent back leg portions of said resilient wire, when snapped into the connected position thereof, extend outwardly from said burner assembly a distance sufficient for said bent back leg portions to be struck against a surface thereby pivoting said resilient wire in a direction opposite to said first direction and releasing said quick connect-disconnect device in a knock-off manner.

* * * * *